US008628349B2

(12) United States Patent
Kim

(10) Patent No.: US 8,628,349 B2
(45) Date of Patent: Jan. 14, 2014

(54) FLEXIBLE PRINTED CIRCUIT BOARD CONNECTOR

(75) Inventor: Min-Cheol Kim, Yongin (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 13/327,465

(22) Filed: Dec. 15, 2011

(65) Prior Publication Data

US 2012/0178285 A1 Jul. 12, 2012

(30) Foreign Application Priority Data

Jan. 10, 2011 (KR) ..... 10-2011-0002302

(51) Int. Cl.
*H01R 12/59* (2011.01)

(52) U.S. Cl.
USPC ..... 439/497; 439/579

(58) Field of Classification Search
USPC ..... 439/92, 95, 569, 571, 579, 682, 493, 439/495, 497, 67, 77
See application file for complete search history.

(56) References Cited

U.S. PATENT DOCUMENTS

| | | | | |
|---|---|---|---|---|
| 7,354,299 | B2 * | 4/2008 | Yamada et al. | 439/497 |
| 7,481,668 | B2 * | 1/2009 | Chiang | 439/492 |
| 7,494,383 | B2 * | 2/2009 | Cohen et al. | 439/638 |
| 7,837,506 | B1 * | 11/2010 | Chiang et al. | 439/607.27 |
| 2006/0252310 | A1 * | 11/2006 | Yamada et al. | 439/579 |
| 2007/0004253 | A1 | 1/2007 | Lee et al. | |
| 2007/0171215 | A1 | 7/2007 | Song | |
| 2011/0193478 | A1 * | 8/2011 | Kim | 315/32 |
| 2012/0178285 | A1 * | 7/2012 | Kim | 439/497 |

FOREIGN PATENT DOCUMENTS

| | | |
|---|---|---|
| JP | 2003-272774 | 9/2003 |
| JP | 2009-033681 | 2/2009 |
| KR | 10-0607680 | 7/2006 |
| KR | 2007-0077682 | 7/2007 |

* cited by examiner

*Primary Examiner* — James Harvey
(74) *Attorney, Agent, or Firm* — Knobbe Martens Olson & Bear LLP

(57) ABSTRACT

A flexible printed circuit board (FPCB) connector configured to be inserted into a socket, the FPCB connector including a plurality of supports that extend from the FPCB connector and support the FPCB connector by contacting a device where the socket is formed to couple the socket and the FPCB connector.

13 Claims, 3 Drawing Sheets

FLEXIBLE PRINTED CIRCUIT BOARD CONNECTOR

CROSS-REFERENCE TO RELATED APPLICATIONS

This application claims the benefit of Korean Patent Application No. 10-2011-0002302, filed on Jan. 10, 2011, in the Korean Intellectual Property Office, the disclosure of which is incorporated herein in its entirety by reference.

BACKGROUND

1. Field

The present disclosure relates to a flexible printed circuit board connector.

2. Description of the Related Technology

A flexible printed circuit board (FPCB) is used in various fields, since a designer can freely print a pattern on a substrate and since it is flexible. In particular, an FPCB is advantageous to use in portions, such as for joining or bending portions, due to its flexibility.

An FPCB can also be used as a connector for connecting connection wires or modules to one another. Since a connector connects two bodies, there are some structural limitations on portions where the connector may be disposed and frequently a physical force is applied to the connector during an operation. An FPCB connector can be readily applied to a region where there is a structural limitation since it has flexibility, and a physical force generated during an operation can be distributed by its flexibility.

SUMMARY OF CERTAIN INVENTIVE ASPECTS

To address the above and/or other problems, the present disclosure provides a flexible printed circuit board (FPCB) connector that can prevent defects due to a physical force applied to the FPCB.

According to an aspect of the present invention, there is provided a flexible printed circuit board (FPCB) connector configured to be inserted into a socket, the FPCB connector including a plurality of supports that extend from the FPCB connector and support the FPCB connector by contacting a device where the socket is formed to couple the socket and the FPCB connector.

The supports may protrude from lateral sides of the FPCB connector.

The supports may extend from a rear surface of the FPCB connector.

Each of the supports may include a connector grounding electrode to which a grounding wire of the socket is electrically connected to couple the FPCB connector and the socket.

The connector grounding electrode may be formed on both sides of the supports.

The FPCB connector may be connected to a cable that transmits electrical signals, the cable may include an external conductor that shields an inner conductor that transmits the electrical signals, and, the connector grounding electrode may be electrically connected to the external conductor of the cable.

The supports may be formed by extending an insulating layer of the FPCB connector and a conductor pattern connected to the grounding wire, and the connector grounding electrode may be electrically connected to the conductor pattern.

The socket may be formed on a flat panel substrate, and the supports may contact the flat panel substrate to couple the socket and the FPCB connector.

The flat panel substrate may be a printed circuit board (PCB).

The PCB may include a PCB grounding electrode electrically connected to a grounding wire, and each of the supports may include a connector grounding electrode that is electrically connected to the PCB grounding electrode to couple the FPCB connector to the socket.

The connector grounding electrodes of the supports may be connected to the PCB grounding electrode by soldering.

The supports may be formed to bond with the flat panel substrate to couple the FPCB connector to the socket.

The supports may be formed by extending an insulating layer of the FPCB connector.

The socket may be a device formed on the PCB of a display apparatus, and the FPCB connector may be connected to cables of a main device.

The socket may be a device formed on the PCB of a display apparatus, and the FPCB connector may be connected to cables of a module of the display apparatus.

According to the current invention, occurrence of defect in the FPCB connector due to a physical force applied to the FPCB connector can be prevented.

BRIEF DESCRIPTION OF THE DRAWINGS

The above and other features and advantages will become more apparent by describing in detail certain embodiments with reference to the attached drawings in which.

DETAILED DESCRIPTION OF CERTAIN INVENTIVE EMBODIMENTS

The following description and the attached drawings are for the purpose of understanding the operation of the present invention, and portions that can be readily realized by those skilled in the art may be omitted. Also, the description and the attached drawings are not intended to be limiting of the invention, but the invention is defined by the scope of the claims. Unless otherwise defined, terminologies used in the embodiments of the inventive concept have the same meaning as commonly understood by one of ordinary skill in the art to which this inventive concept belongs.

The present disclosure will now be described more fully with reference to the accompanying drawings, in which certain embodiments of the present invention are shown.

Figure 1:
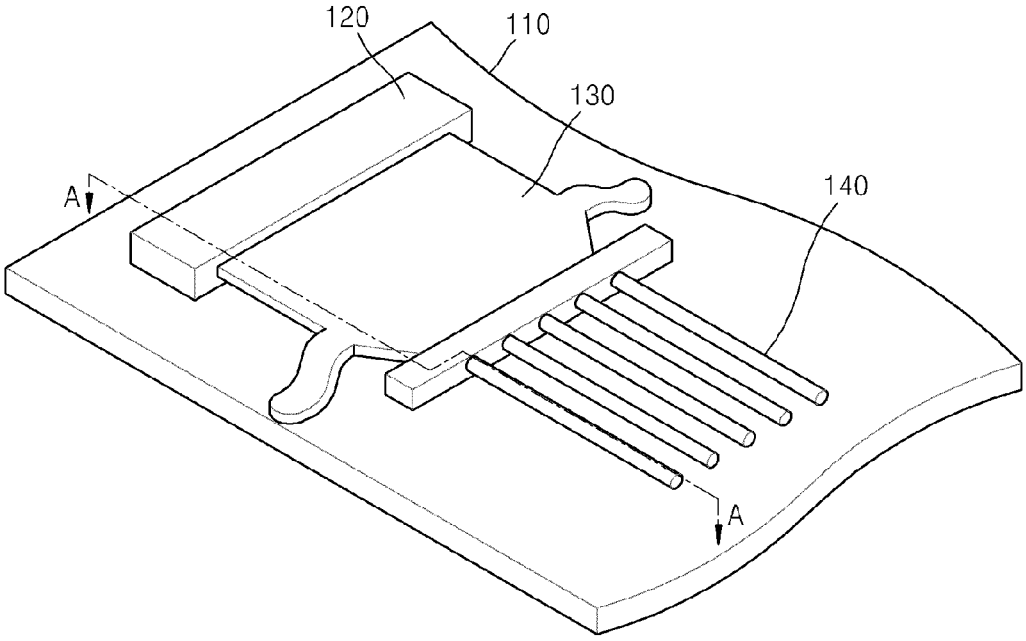
FIG. 1 is a perspective view showing a structure of an embodiment of a flexible printed circuit board (FPCB) connector.

FIG. 1 is a perspective view showing a structure of an embodiment of a flexible printed circuit board (FPCB) connector 130.

The FPCB connector 130 may be coupled to a socket 120 formed on a flat panel substrate 110. In some embodiments, the flat panel substrate 110 may be a printed circuit board (PCB).

The FPCB connector 130 may be connected to cables 140 that transmit electrical signals transmitted from a predetermined module (not shown) connected to the PCB 110, and thus, may connect the cables 140 and the PCB 110. The cables 140 are an example of wires that may be connected to the FPCB connector 130, and various other kinds of wires may be connected to the FPCB connector 130. Electrical signals transmitted by the cables 140 may be various electrical signals such as an electromagnetic signal that transmits data, power, and the like.

The FPCB connector 130 may include on lateral sides thereof, supports 150*a* (refer to FIG. 3) having a wing shape. The supports 150*a* extend from the FPCB connector 130 to support the FPCB connector 130 by contacting the PCB 110 when the FPCB connector 130 is coupled to the PCB 110.

The supports 150*a* having a wing shape extending from the FPCB connector 130 can readily and flexibly contact the PCB 110. Since the supports 150*a* have elasticity as well as flexibility, when a physical pressure is applied to the FPCB connector 130, the supports 150*a* may effectively support the FPCB connector 130. Furthermore, since the supports 150*a* extend from the FPCB connector 130, the supports 150*a* may be formed without an additional process for forming the supports 150*a*, may have a bonding force with the FPCB connector 130 superior to that of the FPCB connector 130 with a structure separately formed from the FPCB connector 130, and may effectively transfer a supporting force of the supports 150*a* to the FPCB connector 130.

Figure 2:
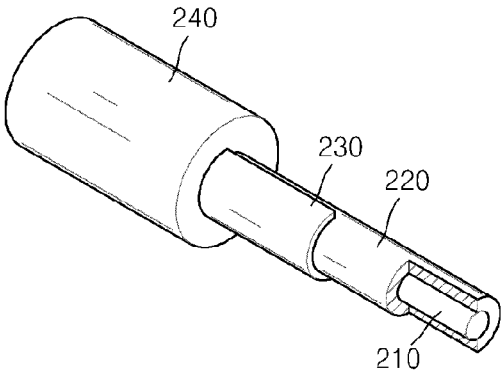
FIG. 2 is a cutaway perspective view of a structure of an embodiment of a cable.

FIG. 2 is a cutaway perspective view of a structure of an embodiment of a cable 140.

The FPCB connector 130 may be connected to the cables 140. As shown in FIG. 2, the cable 140 may include an inner conductor 210, a first insulator 220, an external conductor 230, and a second insulator 240. The cable 140 may be a coaxial cable, and the inner conductor 210 and the external conductor 230 may be concentric with each other.

The inner conductor 210 is a conductor that transmits electrical signals or power. The first insulator 220 protects the inner conductor 210 by surrounding the inner conductor 210, and insulates the inner conductor 210 from the external conductor 230. In some embodiments, the inner conductor 210 and the first insulator 220 are formed along a single line. In other embodiments, a single cable 140 may include a plurality of signal lines by forming a plurality of the inner conductors 210 and a plurality of the first insulators 220 within the external conductor 230.

The external conductor 230 shields electrical signals that are transmitted through the inner conductor 210 from outside elements in an axial direction, and prevents the electrical signals that are transmitted through the inner conductor 210 from being interfered by noise. The second insulator 240 is formed to surround the external conductor 230, and thus, protects and insulates the external conductor 230 from outside elements.

The external conductor 230 acts as a shield of the inner conductor 210 to shield electrical signals transmitted through the inner conductor 210 from noise entered from outside the cable 140 and/or a signal transmitted through another cable. When noise or a signal transmitted through another cable enters into the inner conductor 210, electrical signals transmitted through the inner conductor 210 may be distorted, and this results in a reduction of signal quality. The external conductor 230 is connected to a grounding wire to shield electrical signals transmitted through the external conductor 230 from noise and another signal, and thus, prevents the electrical signals from being distorted.

The external conductor 230 is connected to a grounding wire of a module connected through the cable 140. Therefore, the external conductor 230 removes a phase difference between modules to be connected through the cable 140, and discharges noise entered into the external conductor 230 through the grounding wire.

The FPCB connector 130 may include an additional electrode in order to electrically connect the external conductor 230 to a PCB grounding electrode 430 (refer to FIG. 4) that is provided on the PCB 110 and that is electrically connected to the grounding wire. In some embodiments, the supports 150*a* of the FPCB connector 130 include connector grounding electrodes 152*a*. The connector grounding electrodes 152*a* are not formed on regions where signal terminals of the FPCB connector 130 are formed. Therefore, an area on which the signal terminals may be formed can be increased, and an area on which the connector grounding electrode 152*a* may be formed can also be increased.

Figure 3:
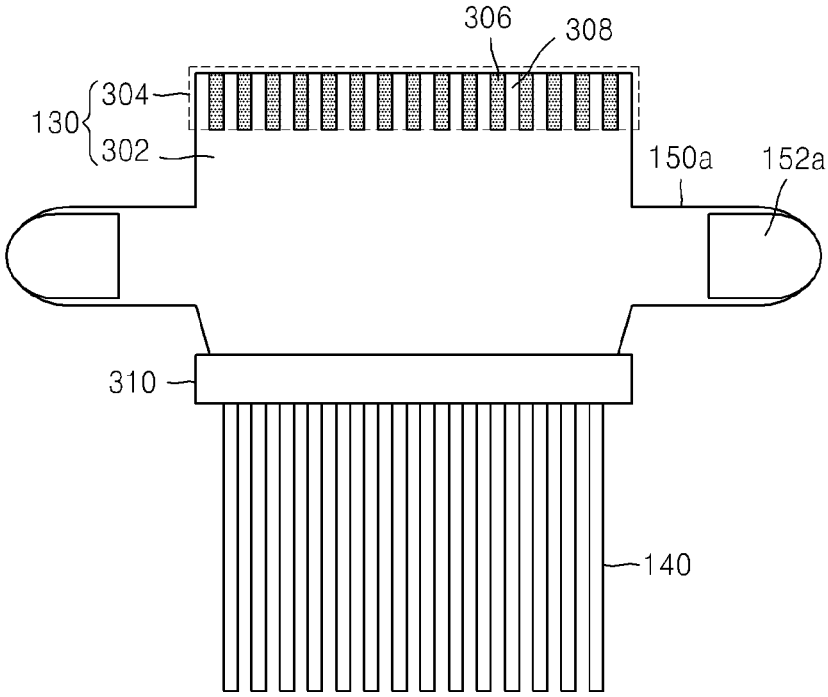
FIG. 3 is a plan view showing the FPCB connector of FIG. 1 before the FPCB connector is connected to a socket of a PCB.

FIG. 3 is a plan view showing the FPCB connector 130 before the FPCB connector 130 is connected to the socket 120 formed on the PCB 110.

Referring to FIG. 3, the FPCB connector 130 includes the supports 150*a* having a wing shape. The supports 150*a* protrude from lateral sides of the FPCB connector 130. Each of the supports 150*a* includes one of the connector grounding electrodes 152*a* electrically connected to the PCB grounding electrode 430 (refer to FIG. 4) included on the PCB 110. The connector grounding electrodes 152*a* may be formed on one side or both sides of the supports 150*a*. When the connector grounding electrodes 152*a* are formed on one side of the supports 150*a*, the connector grounding electrodes 152*a* are formed on surfaces of the supports 150*a* that contact the PCB grounding electrode 430.

The FPCB connector 130 includes an insulator 302 and an electrode unit 304. The insulator 302 is formed to insulate a conductive layer 410 (refer to FIG. 4) of the FPCB connector 130 from outside elements by using an insulating member. The electrode unit 304 includes a plurality of signal electrodes 306 respectively corresponding to signals transmitted through the cables 140. The signal electrodes 306 are formed to be electrically and respectively connected to the cables 140. The signal electrodes 306 are electrically insulated from each other by inter-electrode insulators 308. The inter-electrode insulators 308 may be formed by extending an insulating member of the insulator 302 to the electrode unit 304.

The FPCB connector 130 may further include a protector 310 formed to surround a connection part between the FPCB connector 130 and the cables 140 to protect the connection part from outside elements. The protector 310 may be formed of a material that can absorb or block an external pressure or an impact to protect the connection part.

Figure 4:
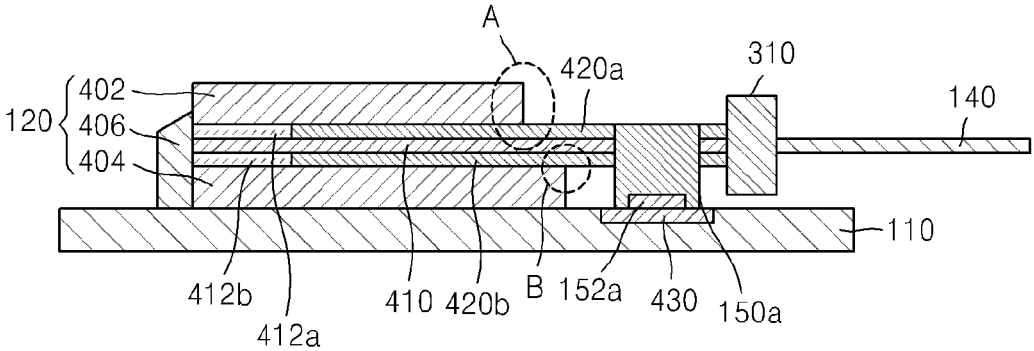
FIG. 4 is a cross-sectional view taken along a line A-A of FIG. 1, in which the FPCB connector of FIG. 1 and a socket are coupled, according to an embodiment.

FIG. 4 is a cross-sectional view taken along a line A-A of FIG. 1, in which the FPCB connector 130 and the socket 120 are coupled.

The FPCB connector 130 may be coupled to the socket 120 of the PCB 110. The socket 120 may include an upper housing 402, a lower housing 404, and socket electrodes 406.

The upper and lower housings 402 and 404 may be formed of an insulator, and have a shape into which the FPCB connector 130 can be inserted.

The socket electrodes 406 are formed of a conductor, are electrically connected to the signal electrodes 306 of the FPCB connector 130, and are electrically connected to signal wires of the PCB 110. Accordingly, a signal exchange between modules connected through the FPCB connector 130 is possible. The socket electrodes 406 may be formed to correspond to a plurality of signals transmitted through the FPCB connector 130. The socket electrodes 406 are electrically insulated from each other.

The FPCB connector 130 may include a conductive layer 410, electrode layers 412*a* and 412*b*, and insulating layers 420*a* and 420*b*.

The conductive layer 410 is electrically connected to the inner conductor 210 (refer to FIG. 2) of the cables 140. A plurality of conductor patterns may be formed in the conductive layer 410 by patterning the conductive layer 410 to respectively correspond to signals transmitted through the cables 140, and the conductor patterns respectively corresponding to the signals transmitted through the cables 140 are insulated from each other. The conductor patterns of the conductive layer 410 are electrically connected to the electrodes 306.

The electrode layers 412*a* and 412*b* include the electrodes 306 (refer to FIG. 3), which are conductor patterns respectively corresponding to signals transmitted through the cables 140. The electrodes 306 are formed to respectively correspond to the conductor patterns of the conductive layer 410 and are formed to be electrically and respectively connected to the conductor patterns of the conductive layer 410. The patterned electrodes 306 of the electrode layers 412*a* and 412*b* respectively correspond to the socket electrodes 406, and are electrically and respectively connected to the socket electrodes 406 when the FPCB connector 130 is coupled to the socket 120.

The supports 150*a* extend from the FPCB connector 130 to contact the PCB 110, and support the FPCB connector 130. The supports 150*a* may be formed by extending the insulating layers 420*a* and 420*b* and the conductive layer 410. The supports 150*a* may be formed by extending a conductor pattern electrically connected to the external conductor 230 (refer to FIG. 2) of the cables 140.

The supports 150*a* may include the connector grounding electrodes 152*a*. The connector grounding electrodes 152*a* are formed to electrically contact the external conductor 230 (refer to FIG. 2) and to electrically contact the conductor pattern extended to form the supports 150*a*. When the FPCB connector 130 is coupled to the socket 120, the connector grounding electrodes 152*a* and the PCB grounding electrode 430 are electrically connected by soldering the supports 150*a* to the PCB grounding electrode 430 of the PCB 110. In some embodiments, the PCB 110 may have a socket structure for accommodating the supports 150*a* of the FPCB connector 130. The PCB grounding electrode 430 may be connected to a predetermined grounding wire. The connector grounding electrodes 152*a* may be formed on a side or both sides of the supports 150*a*.

Cracks may occur on portions A and/or B (refer to FIG. 4) of the FPCB connector 130 due to a bending force and a friction force applied to the portions A and/or B when the FPCB connector 130 is coupled to the socket 120. Cracks may also occur on the portions A and/or B by a pressure applied to the portions A and/or B due to an external pressure or an elastic force corresponding to the external pressure. However, even if a bending force, a friction force, or an external pressure is applied to the FPCB connector 130, since the supports 150*a* prevent the FPCB connector 130 from bending due to a bonding force between the PCB 110 and the support 150*a*, occurrence of cracks on the FPCB connector 130 can be effectively prevented.

Figure 5:
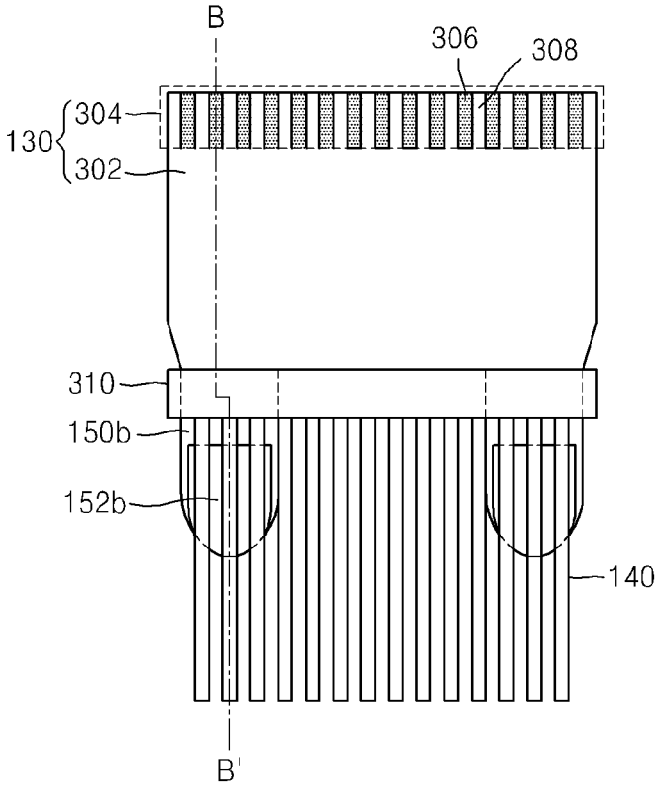
FIG. 5 is a plan view of a structure of another embodiment of an FPCB connector.

FIG. 5 is a plan view of the structure of another embodiment of a FPCB connector 130.

As shown in FIG. 5, supports 150*b* may be formed on a rear surface of the FPCB connector 130. In this structure, since the supports 150*b* do not protrude from lateral sides, manufacturing, storing, and transportation of the FPCB connector 130 may be relatively easier. The supports 150*b* may extend from an insulator 302 in a direction in which a socket 120 and the FPCB connector 130 are coupled to each other.

Figure 6:
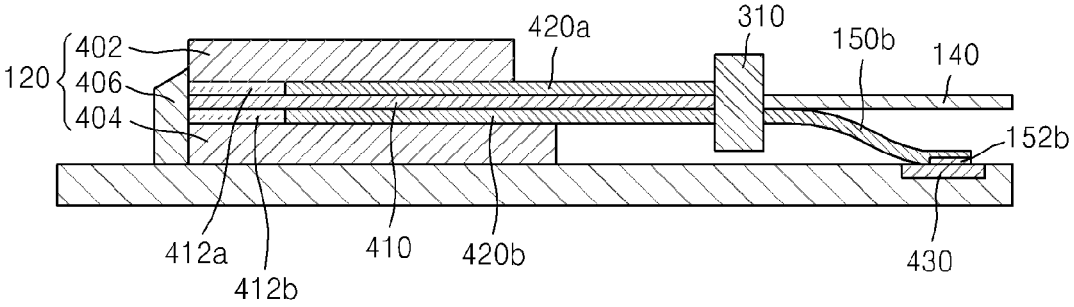
FIG. 6 is a cross-sectional view taken along a line B-B' of FIG. 5, in which the FPCB connector of FIG. 5 and a socket are coupled, according to another embodiment.

FIG. 6 is a cross-sectional view taken along a line B-B', in which the FPCB connector 130 and the socket 120 are coupled, according to another embodiment.

Referring to FIG. 6, the supports 150*b* may be structured to support the FPCB connector 130 by extending an insulating layer 420*b* on a rear surface of the FPCB connector 130 and contacting a PCB 110. The supports 150*b* may be formed by extending conductor patterns of a conductive layer 410 that electrically contacts the insulating layer 420*b* and the external conductor 230 (refer to FIG. 2).

The supports 150*b* may include connector grounding electrodes 152*b* on one side or both sides thereof. The connector grounding electrodes 152*b* may be formed to electrically contact the conductor patterns of the conductor layer 410 that are electrically connected to the external conductor 230. The connector grounding electrodes 152*b* are formed to electrically contact a PCB grounding electrode 430 when the supports 150*b* are connected to the PCB 110, such as, for example, by soldering, in order to couple the FPCB connector 130 to the socket 120 of the PCB 110.

Embodiments of the FPCB connectors 130 can be used to connect modules in display apparatuses where PCBs of the display apparatuses are connected to main devices. The FPCB connectors 130 can increase structural strength of the display apparatuses by being applied to display apparatuses.

While this invention has been particularly shown and described with reference to certain embodiments thereof, it will be understood by those skilled in the art that various changes in form and details may be made therein without departing from the spirit and scope of the invention as defined by the appended claims. The disclosed embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A flexible printed circuit board (FPCB) connector configured to be inserted into a socket, the FPCB connector comprising:

an insulator; and an electrode unit;

wherein the insulator comprises a body portion and a plurality of supports that extend from the body portion, the plurality of supports contacting a surface where the socket is formed to thereby support the FPCB connector and to couple the socket and the FPCB connector.

2. The FPCB connector of claim 1, wherein each of the plurality of supports protrudes from lateral sides of the body portion of the insulator.

3. The FPCB connector of claim 1, wherein the supports extend from a rear surface of the FPCB connector.

4. The FPCB connector of claim 1, wherein each of the plurality of supports comprises a connector grounding electrode configured to couple the FPCB connector and the socket.

5. The FPCB connector of claim 4, wherein the supports are formed on both sides of the body portion.

6. The FPCB connector of claim 4, wherein the FPCB connector is connected to a cable that transmits electrical signals, the cable comprising an external conductor that shields an inner conductor that transmits the electrical signals, and wherein the connector grounding electrode is electrically connected to the external conductor of the cable.

7. The FPCB connector of claim 1, wherein the FPCB connector is connected to cables of a device separate from the display apparatus.

8. The FPCB connector of claim 1, wherein the surface comprises a flat panel substrate.

9. The FPCB connector of claim 8, wherein the flat panel substrate is a printed circuit board (PCB).

10. The FPCB connector of claim 9, wherein the PCB comprises a PCB grounding electrode, and wherein each of the plurality of supports comprises a connector grounding electrode that is electrically connected to the PCB grounding electrode to couple the FPCB connector to the socket.

11. The FPCB connector of claim 10, wherein the connector grounding electrodes of each of the plurality of supports is connected to the PCB grounding electrode by soldering.

12. The FPCB connector of claim 8, wherein each of the plurality of supports is formed to bond with the flat panel substrate to couple the FPCB connector to the socket.

13. A flexible printed circuit board (FPCB) connector configured to be inserted into a socket, the FPCB connector comprising:

an insulator which comprises a body portion and a plurality of supports that extend from the body portion, the plurality of supports formed to bond with a flat panel substrate where the socket is formed to thereby support the FPCB connector and to couple the socket and the FPCB connector.

* * * * *